US008896191B2

(12) United States Patent
Moskowitz

(10) Patent No.: US 8,896,191 B2
(45) Date of Patent: Nov. 25, 2014

(54) MERCURY-FREE DISCHARGE LAMP

(75) Inventor: Philip E. Moskowitz, Georgetown, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 438 days.

(21) Appl. No.: 13/179,596

(22) Filed: Jul. 11, 2011

(65) Prior Publication Data

US 2013/0015754 A1 Jan. 17, 2013

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |
| ***H01J 1/50*** | (2006.01) |
| ***H01J 3/20*** | (2006.01) |
| ***H01J 3/32*** | (2006.01) |
| ***H01J 23/10*** | (2006.01) |
| ***H01J 29/76*** | (2006.01) |
| ***H01J 65/04*** | (2006.01) |

(52) U.S. Cl.
CPC ..... *H01J 65/048* (2013.01)
USPC ..... 313/46; 313/161

(58) Field of Classification Search
CPC ..... H01J 65/048
USPC ..... 313/46, 153, 160, 161
See application file for complete search history.

(56) References Cited

U.S. PATENT DOCUMENTS

| | | | | |
|---|---|---|---|---|
| 5,959,405 | A | 9/1999 | Soules | |
| 6,157,141 | A * | 12/2000 | Lapatovich et al. | 315/248 |
| 6,249,090 | B1 * | 6/2001 | Popov et al. | 315/248 |
| 6,670,759 | B1 * | 12/2003 | Katase et al. | 313/638 |
| 2003/0076020 | A1 * | 4/2003 | Anami et al. | 313/35 |
| 2003/0209970 | A1 | 11/2003 | Bader | |
| 2006/0071584 | A1 | 4/2006 | Kurachi | |
| 2006/0108945 | A1 * | 5/2006 | Chandler et al. | 315/248 |
| 2006/0132043 | A1 | 6/2006 | Srivastava et al. | |
| 2009/0273267 | A1 | 11/2009 | Stockwald et al. | |

FOREIGN PATENT DOCUMENTS

| | | | |
|---|---|---|---|
| EP | 0586180 | A1 | 3/1994 |
| JP | 54054473 | A | 4/1979 |

OTHER PUBLICATIONS

PCT/US2012/036890 filed May 8, 2012 search report mailed Jul. 25, 2012.

* cited by examiner

*Primary Examiner* — Anh Mai
*Assistant Examiner* — Zachary J Snyder
(74) *Attorney, Agent, or Firm* — Andrew Martin

(57) ABSTRACT

The present invention provides a low pressure metal halide fluorescent lamp. The metal halide fluorescent lamp may have an oblate spheroid cavity discharge vessel filled with an ionizable metal halide surrounding an exciter housing. An exciter within the exciter housing may drive the ionizable metal halide in an inductively coupled electrode-less manner. One or more embodiments may include one or more heat spreaders and/or thermal transfer pipes for transferring heat from the exciter to a surface of the oblate discharge vessel.

19 Claims, 7 Drawing Sheets

700

MERCURY-FREE DISCHARGE LAMP

TECHNICAL FIELD

This invention relates to fluorescent lamps and more particularly to a metal halide fluorescent discharge lamp.

BACKGROUND OF THE INVENTION

Electrodeless metal halide lamps, in general, have an electrodeless discharge vessel containing an ionizable discharge medium. An electric field produces a light-emitting plasma discharge from the ionizable discharge medium within the discharge vessel. The applied electric field is produced by an exciter. The exciter delivers radio frequency (RF), or more particularly ultra-high frequency (UHF), electric field to the discharge vessel and may be a separate unit which may need to be incorporated within the lamp.

Typically, the discharge medium may be in a gas or a vapor phase and is contained by the discharge vessel. As the ionized atoms and molecules relax to a lower energy state, they emit radiation. The discharge vessel is capable of transmitting the generated radiation out of the discharge vessel. Most of the currently used discharge radiation sources contain mercury as a component of the ionizable discharge medium due to its efficient discharge characteristics.

Accidental release or routine end-of-life disposal of mercury-containing ionizable discharge source medium may be potentially harmful to the environment and/or present immediate health concerns. Therefore, there is a need to develop a mercury-free discharge composition and a lamp with improved efficiency.

SUMMARY OF THE INVENTION

An embodiment of the present invention may be a metal halide fluorescent lamp, systems, or methods thereof. The metal halide fluorescent lamp may have an oblate spheroid cavity discharge vessel. The discharge vessel may be filled with an ionizable metal halide surrounding an exciter housing. An exciter within the exciter housing may drive the ionizable metal halide in an inductively coupled electrodeless manner.

In another embodiment, the lamp may include one or more heat spreaders or transfer caps for transferring heat from the exciter to an outer surface of a discharge vessel. The one or more heat transfer caps may be made of boron nitride. A thermal paste may be used to couple the one or more heat transfer caps to the outer surface of the discharge vessel.

In another embodiment, one or more thermal transfer pipes may be used to transfer heat from the exciter to an outer surface of the discharge vessel. The one or more thermal transfer pipes may transfer heat from a core of the exciter to a polar region surface of the discharge vessel. The one or more thermal transfer pipes may each have a thermal conductivity of about 12.6 W/cm*K.

Other embodiments may include one or more of the following variations. The ionizable metal halide may be gallium and a halogen. The ionizable metal halide may also be mercury-free. The oblate spheroid cavity discharge vessel may have an overall width of about 100 mm and an overall height of about 50 mm. The exciter housing may have a cylindrical shape and a diameter of about 30 mm. The lamp may be operated at 60 watts and maintains the entire oblate spheroid cavity discharge vessel surface at 110 C or greater. The exciter may provide an RF sinusoidal current producing a toroidal-shaped plasma in the oblate spheroid cavity discharge vessel.

The present invention is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention.

DETAILED DESCRIPTION OF THE INVENTION

Figure 1:
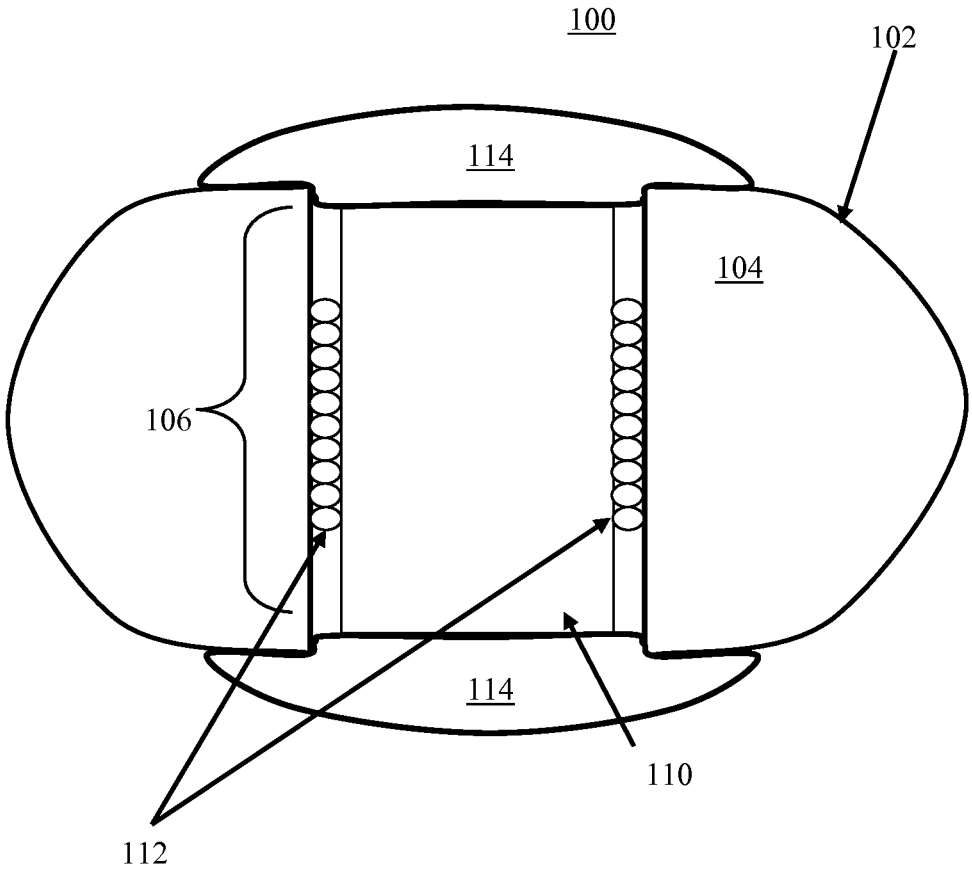
FIG. 1 is a cross-sectional illustration of a mercury-free discharge lamp with thermal transfer caps according to an exemplary embodiment of the invention.

It is desirable to remove mercury from fluorescent lamps for environmental and health reasons. A low-pressure gallium iodide discharge lamp may be made sufficiently efficacious to be considered as a substitute for mercury containing discharge medium, under certain conditions. The conditions depend upon the discharge current, the temperature of the gallium iodide condensate, the temperature of the discharge vessel walls, and the type and pressure of the rare gas which fills the discharge vessel as in conventional fluorescent lamps. Unlike the conventional fluorescent lamp, the gallium iodide condensate may need to be maintained at roughly 105° C., with the rest of the discharge vessel walls at somewhat higher temperature (about 110° C. or greater). This temperature may be used to create a vapor pressure of gallium iodide of roughly about 1 Pascal (Pa). Additionally, a phosphor, required for the purpose of converting gallium iodide ultraviolet emission to visible wavelengths, may need to be placed on the outside surface of the discharge vessel so as to prevent water vapor contamination of the internal atmosphere, destroying the radiative efficiency of the discharge medium. Radiative efficiency is defined as the power radiated divided by the input power. A rare gas of the discharge medium may be chosen from helium, neon, argon, krypton, or xenon, but preferred results have been obtained with argon at pressures below 133 Pa using electrodeless excitation.

Embodiments of the invention may provide a low pressure mercury-free metal halide spheroidal discharge vessel. The spheroidal discharge vessel may be driven with a RF sinusoidal current in an inductively coupled electrodeless mode for the purpose of maximizing the efficiency of production of useful radiation. Embodiments of the invention may require discharge vessel wall temperatures of 100° C. or higher; it may be critical that a given bulb design utilize the "waste" heat of the lamp to keep the discharge vessel at temperature most efficiently.

Embodiments of the invention may provide a spherical and/or linear discharge vessel that conventionally may not have provided efficient operation due to unintended "cold spot" formation. Cold spots may be identified as parts of the discharge vessel that may remain too cool due to the fact that the plasma does not completely fill the discharge vessel interior volume. Increasing the input power to increase the overall temperature to compensate for these cold spots often may overheat the ferrite inductor (the "exciter"). The overheated exciter often results in destruction of the magnetic properties of said exciter and/or creates a less efficient discharge due to heat loss and saturation effects. Using an outer transparent jacket may also prevent formation of unintended cold spots; however, the bulb is more difficult and more costly to manufacture, the outer jacket can absorb some of the radiation making it less efficient, and the jacketed lamp must be physically larger than the discharge vessel. Embodiments of the invention may provide a shape of the discharge vessel that is optimized to a shape of the inductively coupled plasma. Embodiments of the invention may also provide transfer of wasted heat generated by the exciter to discharge vessel. Embodiments of the invention may also utilize heat spreaders, for example, top and bottom caps which increase the temperature of the coolest parts of the bulb.

Figure 2:
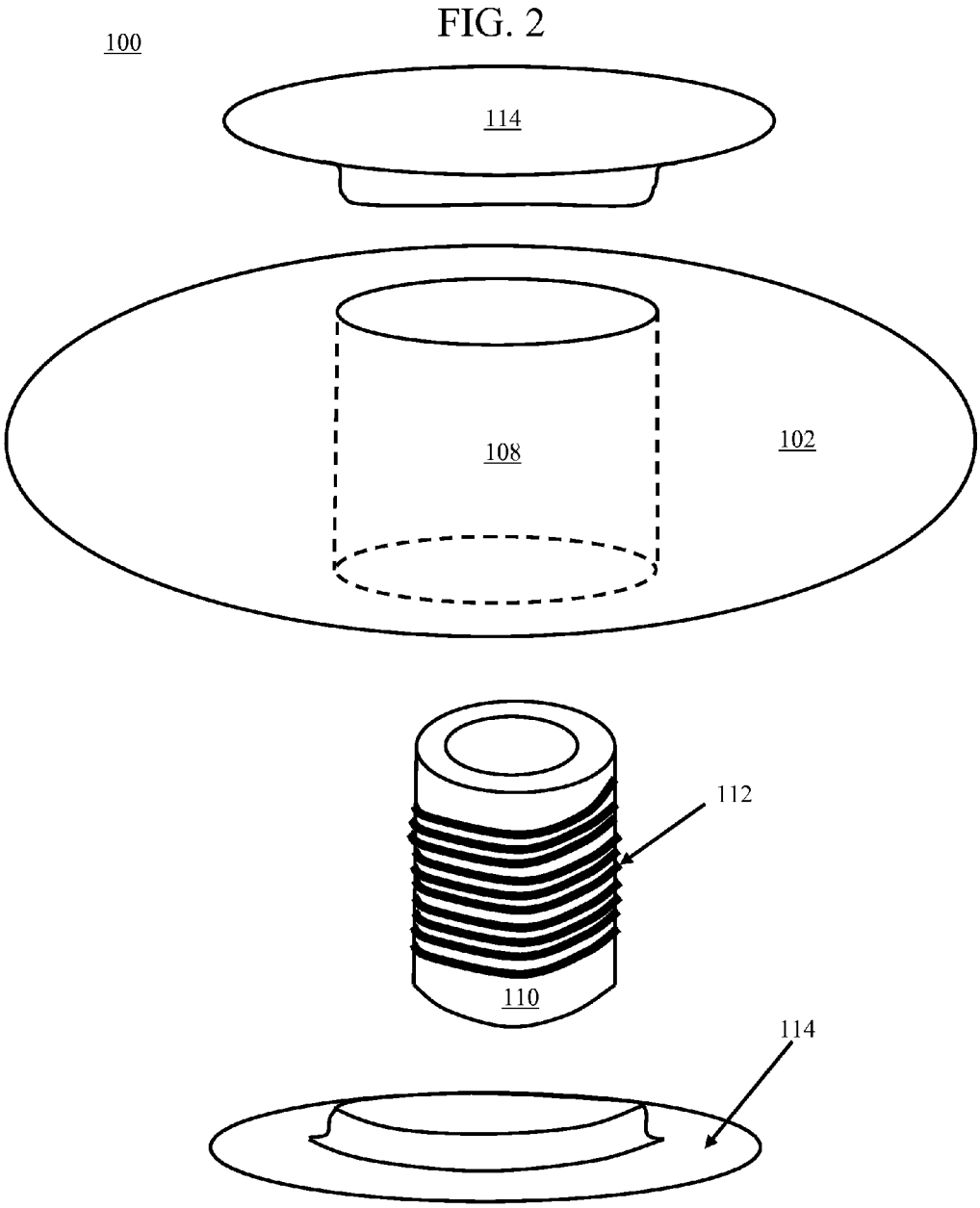
FIG. 2 is a perspective illustration of the mercury-free discharge lamp with thermal transfer caps according to an exemplary embodiment of the invention.

Referring to FIGS. 1 and 2, a low pressure metal halide fluorescent lamp 100 is provided according to an exemplary embodiment of the invention. The lamp 100 includes an oblate spheroid cavity discharge vessel or bulb 102. The discharge vessel 102 has an oblate spheroid shape to maximize even heat transfer from the toroidal shaped excited plasma of a discharge medium 104 within the discharge vessel 102. The oblate shape decreases the distance of the discharge vessel 102 interior surfaces at the polar or top and bottom regions to the toroidal shaped excited discharge medium 104, thereby increasing the heat transfer and surface temperature of the polar regions of the discharge vessel 102 over conventional spherical discharge vessels. The discharge vessel may be constructed of silica glass for purity and absence of water; however, borosilicate and soda lime glasses may also be used, provided processing steps are implemented to remove water from the surface and just below the surface.

Embodiments of the invention are not limited to an oblate spheroid shape. Embodiments may provide a variety of shapes of the discharge vessels that are optimized to a shape of the inductively coupled plasma and thereby eliminating or reducing cold spots due to the plasma not completely filling the discharge vessel's interior volume.

In accordance with one aspect of the invention, the discharge medium 104 may be a mercury-free discharge composition capable of emitting radiation when excited. The mercury-free discharge composition may include gallium and a halogen. The halogen may include chlorine, bromine, iodine, or combinations of these materials. The mercury-free discharge composition may include one of gallium iodide, gallium chloride, gallium bromide, and/or a mixture of two or more of gallium halides. Gallium and halogen may be present along with any other elements or compounds other than mercury and mercury containing compounds.

The mercury-free discharge composition may be capable of emitting radiation when excited. Upon excitation, the mercury-free discharge material may dissociate and form into different species depending on the energy available for the reactions. The different species may include ions, atoms, electrons, molecules or any other free radicals. At any given instant during discharge, the discharge composition may be a combination of these species. For example, in a mercury-free discharge composition including gallium and iodine, upon excitation, the discharge composition may include a mixture of metallic gallium, gallium ions, iodide ions, GaI, $GaI_2$, or $GaI_3$, electrons, and various combinations of these species. The amount of each of these species may depend on the amount of discharge material, internal pressure, and temperature during operation. These dissociative/formation reactions may be reversible and may occur constantly or otherwise repeatedly under steady state conditions.

The mercury-free discharge composition may further include an inert buffer gas. The inert buffer gas may include helium, neon, argon, krypton, xenon, or combinations thereof. The inert buffer gas may enable or otherwise facilitate the gas discharge to be more readily ignited. The inert buffer gas may also control the steady state operation of the radiation source, and may further be used to optimize operation of the radiation source. In a non-limiting example, argon may be used as the inert buffer gas. However, argon may be substituted, either completely or partly, with one or more other inert gasses, such as helium, neon, krypton, xenon, or combinations thereof.

The emission spectra from the emitted radiation of the mercury-free discharge medium may be tuned and hence optimized for increased efficiency by changing one or more characteristics of the lamp. For example, the amount of discharge medium introduced into the discharge vessel can be changed, the pressure within the discharge vessel can be changed, and the temperature of the discharge composition during discharge can be changed. Apart from these parameters, various other factors such as the current density, lamp radius, getters, complexing additives, and other parameters may be tuned to optimize the efficiency of the discharge.

An exciter 106 within the center of the discharge vessel 102 is used to excite the discharge medium 104 to provide the excited plasma. The exciter 106 may be provided within an exciter housing 108. The exciter housing 108 may be formed by a cylindrical interior wall of the discharge vessel 102 wherein the discharge vessel 102 has oblate spheroid shape with interior walls providing a sealed "donut-shaped" vessel with a cylindrical open center for housing the exciter 106. Both the top and bottom of the exciter housing 108 may be open to the exterior; however, it will be understood that embodiments of the invention may have only a top or bottom opening providing, for example, an oblate spheroid discharge vessel 102 with an interior cylindrical shaped exciter housing 108 opened only to the top or bottom.

A phosphor composition may be coated on the outer surface of the discharge vessel 102. The phosphor composition absorbs radiation in the ultraviolet spectrum and emits light in the visible spectrum by various compositions and processes already known. For example, in a discharge medium including a gallium iodide based discharge composition, the radiation output may be dominated by spectral transitions between 250 nanometers to about 294 nanometers, band at 380 nanometers to about 400 nanometers, at about 403 nanometers and another at about 417 nanometers. In such embodiments, a suitable phosphor composition that absorbs radiation having at least one of these wavelengths and emits in the visible spectrum may be used. The discharge vessel 102 may be made of a material that does not absorb a substantial amount of the radiation emitted by the discharge medium 104. A suitable material for this embodiment may be quartz, which absorbs little radiation in the ultraviolet spectrum range. The phosphor layer coatings may be formed by various already known procedures including deposition from liquid suspensions and electrostatic deposition. For example, the phosphor may be deposited on the outer discharge vessel 102 surface from a conventional aqueous suspension including various organic binders and adhesion promoting agents. The aqueous suspension may be applied and then dried in the conventional manner. As used herein, the term 'phosphor composition' may simply refer to a single phosphor or may refer to a blend of phosphors or to a blend of materials including at least one phosphor.

The exciter 106 may include a ferrite tube core 110 wound with turns of coated wire 112 to produce the exciter 106. The exciter 106 is positioned within the exciter housing 108 during manufacturing and allows for the exciter 106 to produce the electromagnetic field in proximity to the discharge vessel 102 to excite the discharge medium 104.

In another exemplary embodiment of the invention, one or more heat spreaders 114 in addition to the shape of the discharge vessel 102 may also be used to facilitate thermal transfer from the exciter 106 to the surfaces of the discharge vessel 102. Heat spreaders or end caps 114 may be used to further facilitate thermal transfer from the exciter 106 to surfaces of the discharge vessel 102. The size and shape of the heat spreaders 114 may be designed to promote even heat transfer from the exciter 106 to avoid cool spots on a surface of the discharge vessel 102. According to an embodiment shown in FIGS. 1 and 2, top and bottom heat spreaders 114 provide heat transfer from the exciter 106 to the top and bottom regions of the discharge vessel 102 that may experience cool temperatures as previously explained.

In addition to the shape and size of the heat spreaders 114, the material of the heat spreaders 114 may include material with good thermal conductivity properties; for example, boron nitride may be used for its high thermal conduction properties. The heat spreaders 114 may be dimensioned so as to form a tight fit within the one or more openings of the exciter housing 108 in the discharge vessel 102. In this way, the heat conducted from the exciter 106 is brought to the discharge vessel 102 at each opening of the exciter housing 108. In addition to a tight fit, thermal adhesives or pastes may be used to further facilitate thermal transfer between the heat spreaders 114 and discharge vessel 102.

Figure 3:
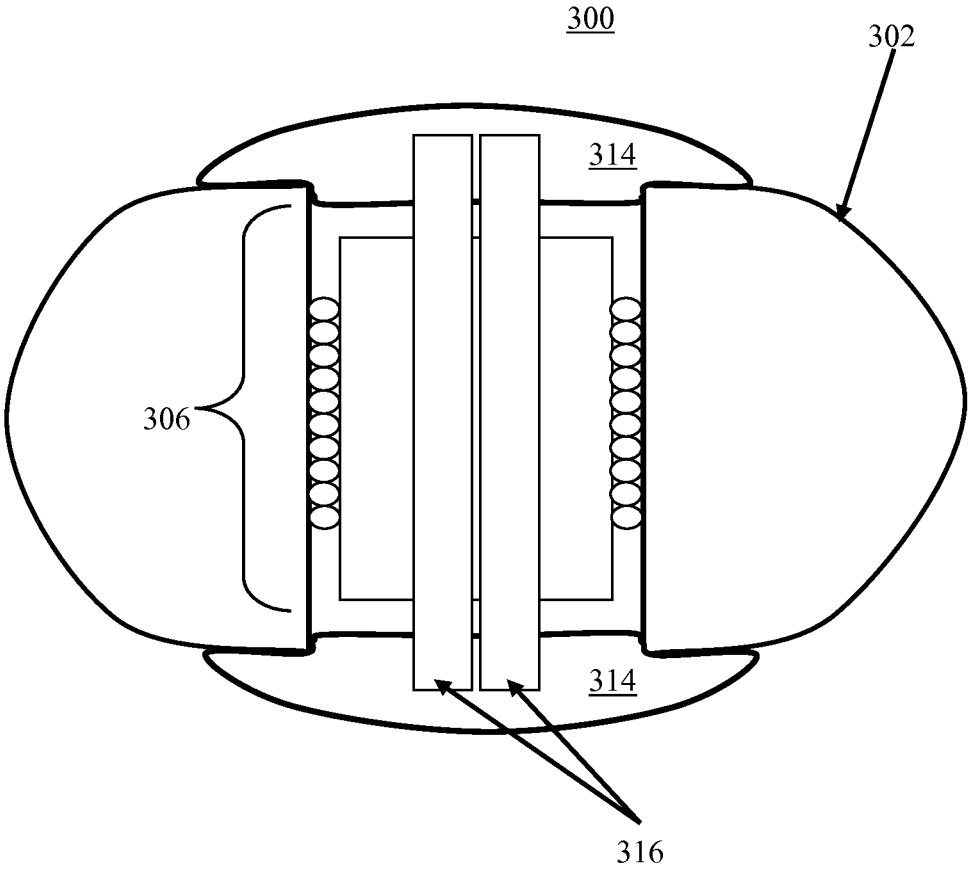
FIG. 3 is a cross-sectional illustration of a mercury-free discharge lamp with thermal transfer pipes according to an exemplary embodiment of the invention.
Figure 4:
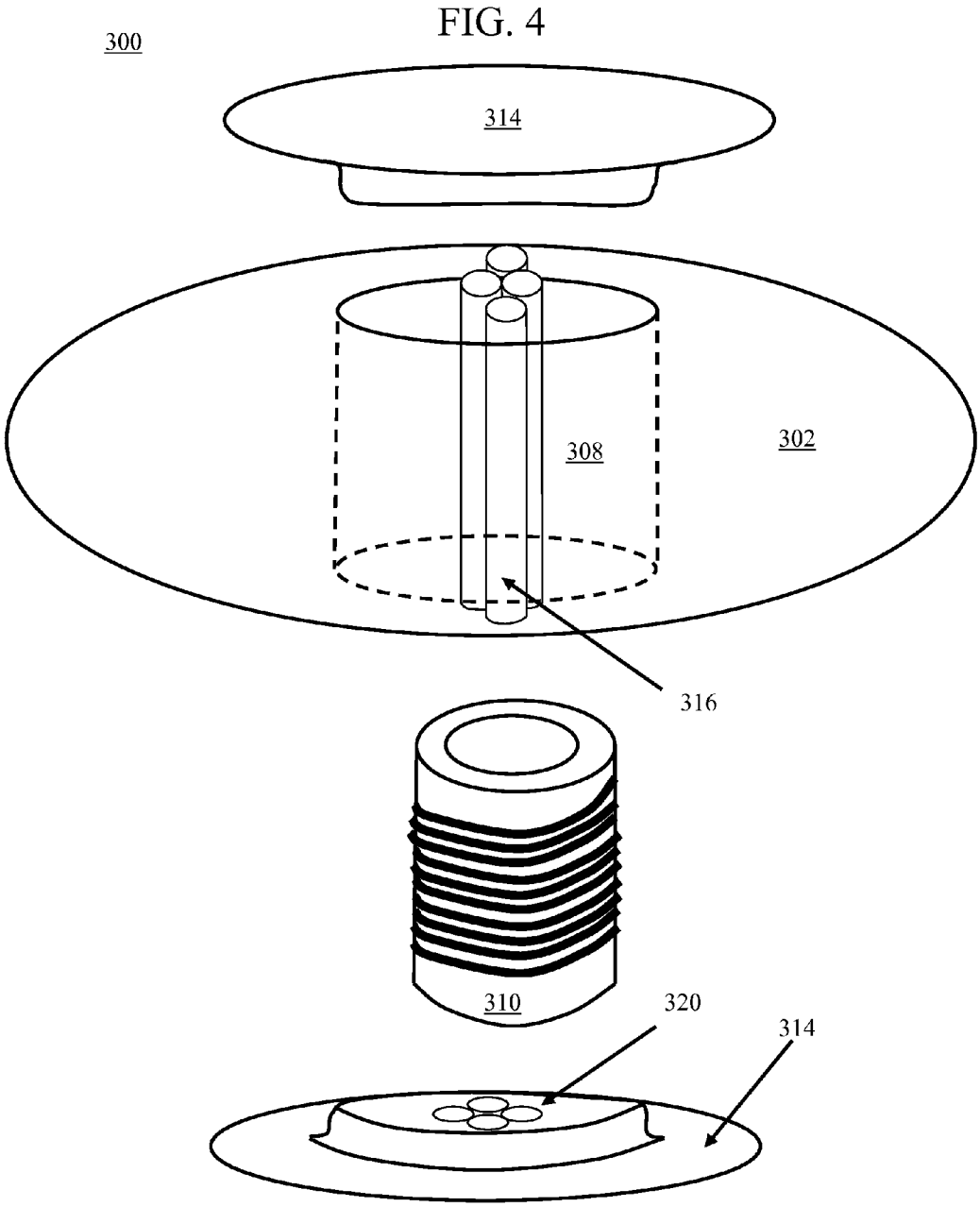
FIG. 4 is a perspective illustration of the mercury-free discharge lamp with thermal transfer pipes according to an exemplary embodiment of the invention

Referring to FIGS. 3 and 4, a low pressure metal halide fluorescent lamp 300 with thermal transfer pipes 316 is provided according to another exemplary embodiment of the invention. One or more thermal transfer pipes 316 may be used to facilitate heat transfer from an exciter 306 to a discharge vessel 302 of the lamp 300, thereby increasing the heat transfer and surface temperature of the polar regions of the discharge vessel 302 over conventional lamps. The discharge vessel 302 may be constructed as previously described in prior disclosed embodiments. The discharge vessel 302 may house gallium and halogen along with any other element or compound other than mercury and mercury containing compounds. The mercury-free discharge composition may be capable of emitting radiation when excited and a phosphor composition may also be coated on the outer surface of the discharge vessel 302.

The exciter 306 may be provided within an exciter housing 308 of the discharge vessel 302 as previously described in prior embodiments. Thermal transfer pipes 316 may run through a ferrite tube core 310 of the exciter 306. The thermal transfer pipes 316 may facilitate the transfer of heat from the center of the core 310 to one or more heat spreaders or end caps 314. The heater spreaders 314 may be used to further facilitate thermal transfer from the exciter 306 to surfaces of the discharge vessel 302.

A set of four thermal transfer pipes 316 may be cemented into the center of the core 310 and extend past both ends of the core. The ends of the thermal transfer pipes 316 may be fitted to within holes 320 in each heat spreaders 314. The holes within the heat spreaders 314 may be dimensioned so as to form a tight fit with each thermal transfer pipe 316. In this way, the heat is conducted from the exciter 306 to the heat spreaders 314 and subsequently to the top and/or bottom regions of the discharge vessel 302. In addition to a tight fit, thermal adhesives or pastes may be used to further facilitate thermal transfer and hold the lamp 300 components together.

The thermal transfer pipes 316 may be a low pressure liquid in contact with a thermally conductive solid surface which turns into a vapor by absorbing heat from the hot surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

The thermal transfer pipes 316 may have a sealed pipe or tube made of a material with high thermal conductivity such as copper or aluminum at both hot and cold ends. A vacuum pump may be used to remove all air from the empty heat pipe, and then the pipe is filled with a fraction of a percent by volume of working fluid (or coolant) chosen to match the operating temperature. Examples of such fluids include water, ethanol, acetone, sodium, or mercury. Due to the partial vacuum that is near or below the vapor pressure of the fluid, some of the fluid will be in the liquid phase and some will be in the gas phase. The use of a vacuum eliminates the need for the working gas to diffuse through any other gas and so the bulk transfer of the vapor to the cold end of the heat pipe is at the speed of the moving molecules. In this sense, the only practical limit to the rate of heat transfer is the speed with which the gas can be condensed to a liquid at the cold end.

The thermal transfer pipes 316 are not limited to the above construction. Embodiments of the invention may include thermal transfer pipes 316 that are a thermosiphon or a solid thermally conductive material, for example, a solid metal or boron nitride cylinder. In addition the size, shape and number of the thermal transfer pipes 316 may be selected or designed based on the desired transfer of heat from the exciter 306 to the heat spreaders 314 and/or cold region on the discharge vessel 302.

Figure 5:
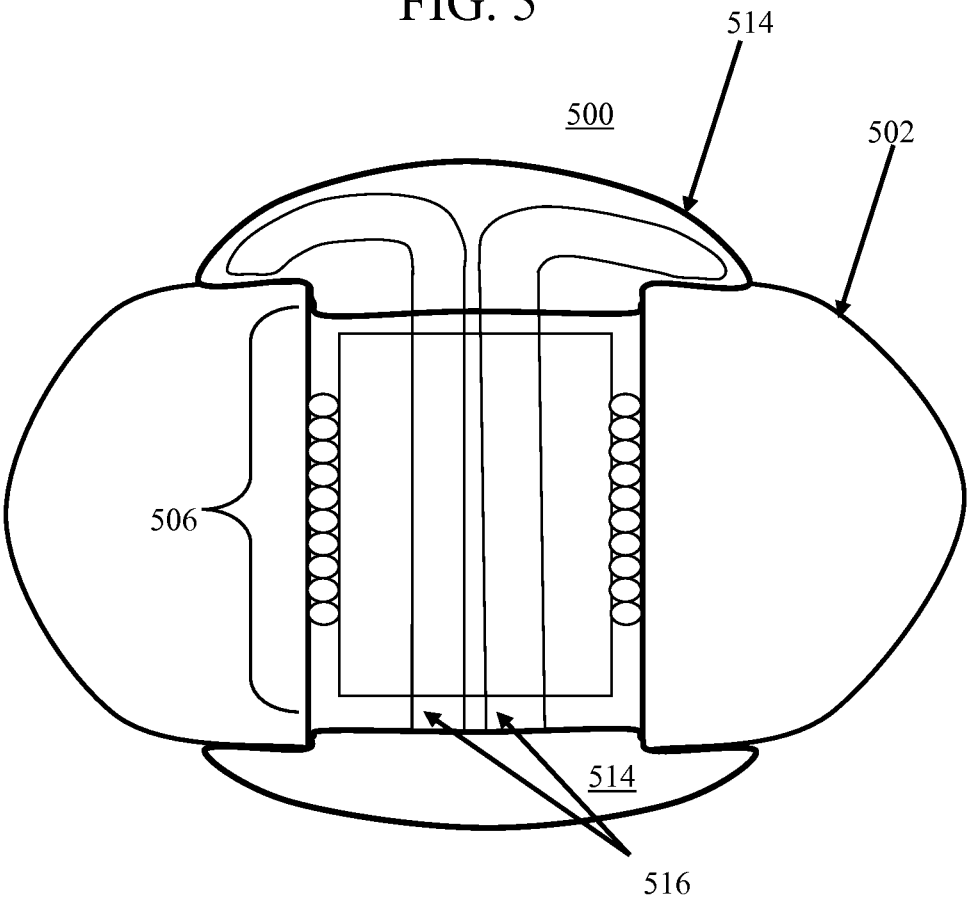
FIG. 5 is a cross-sectional illustration of a mercury-free discharge lamp with additional thermal conduction according to an exemplary embodiment of the invention.

Referring to FIG. 5, a low pressure metal halide fluorescent lamp 500 with thermal transfer pipes 516 is provided according to another exemplary embodiment of the invention. One or more thermal transfer pipes 516 may be used to further facilitate heat transfer from an exciter 506 to heat spreaders 514 and onto cold spots of a discharge vessel 502 of the lamp 500, thereby increasing the heat transfer and surface temperature of the cold spots of the discharge vessel 502 over conventional lamps. The thermal transfer pipes 516 may be designed to extend and bend within the heat spreaders 514 to further facilitate thermal transfer within the heat spreaders 514 and/or to the desired cooler regions of the discharge vessel 502. The thermal transfer pipes 516 may be molded into the heat spreaders 514 during construction of the heat spreaders 514. In the specific embodiment of FIG. 5, the thermal transfer pipes 516 may extend and bend within only one of the caps. This may be used to allow construction of the lamp 500 by inserting the thermal transfer pipes 516 through the exciter core. The other end cap may be fixed to the other end of the thermal transfer pipes 516, thereby securing the end caps to the exciter 506 and discharge vessel 502. The discharge vessel 502 and exciter 506 may be as previously described in prior disclosed embodiments. The discharge vessel 502 may house gallium and halogen along with any other element or compound other than mercury and mercury containing compounds. The mercury-free discharge composition may be capable of emitting radiation when excited and a phosphor composition may also be coated on the outer surface of the discharge vessel 502. The thermal transfer pipes 516 and heat spreaders 514 are not limited to the above described construction. In another embodiment (not shown), both top and bottom portions of the thermal transfer pipes 516 extend and bend within top and bottom heat spreader caps. The heat spreader caps may both be molded to the top and bottom ends of the thermal transfer pipes 516 subsequent to being inserted into the exciter and/or discharge vessel 502.

Figure 6:
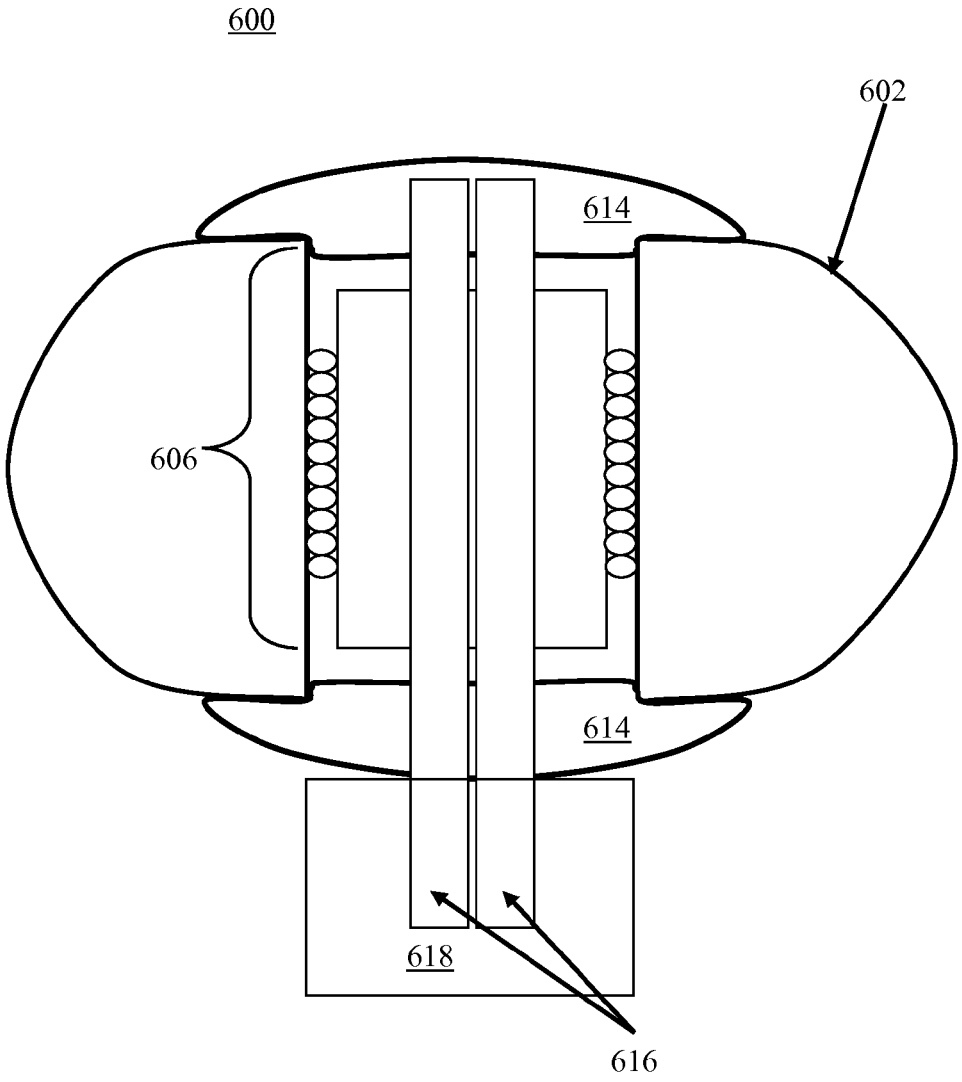
FIG. 6 is a cross-sectional illustration of a mercury-free discharge lamp with additional thermal dissipation according to an exemplary embodiment of the invention.

Referring to FIG. 6, a low pressure metal halide fluorescent lamp 600 with thermal transfer pipes 616 with heat sink 618 is provided according to another exemplary embodiment of the invention. One or more thermal transfer pipes 616 may be used to further facilitate heat transfer from an exciter 606 to heat spreaders 614 and/or heat sink 618, thereby providing for the heat transfer surface to the polar regions of the discharge vessel 602 and allowing heat dissipation by the lamp 600. The thermal transfer pipes 616 may be designed to extend through the heat spreaders 614 and to heat sinks 618 to further facilitate thermal transfer from the exciter 606. The heat sink 618 may be, for example, fins on the top and/or bottom to further facilitate the transfer of waste heat to the surrounding air of the lamp 600. The discharge vessel 602 and exciter 606 may be constructed as previously described in prior disclosed embodiments. The discharge vessel 602 may house gallium and halogen along with any other element or compound other than mercury and mercury containing compounds. The mercury-free discharge composition may be capable of emitting radiation when excited and a phosphor composition may also be coated on the outer surface of the discharge vessel 602. The size and shape of the heat sink 618 may be designed to promote heat transfer from the exciter 606 and to cold spots on a surface of the discharge vessel 602 while avoiding overheating of the exciter 606.

Example 1

Figure 7:
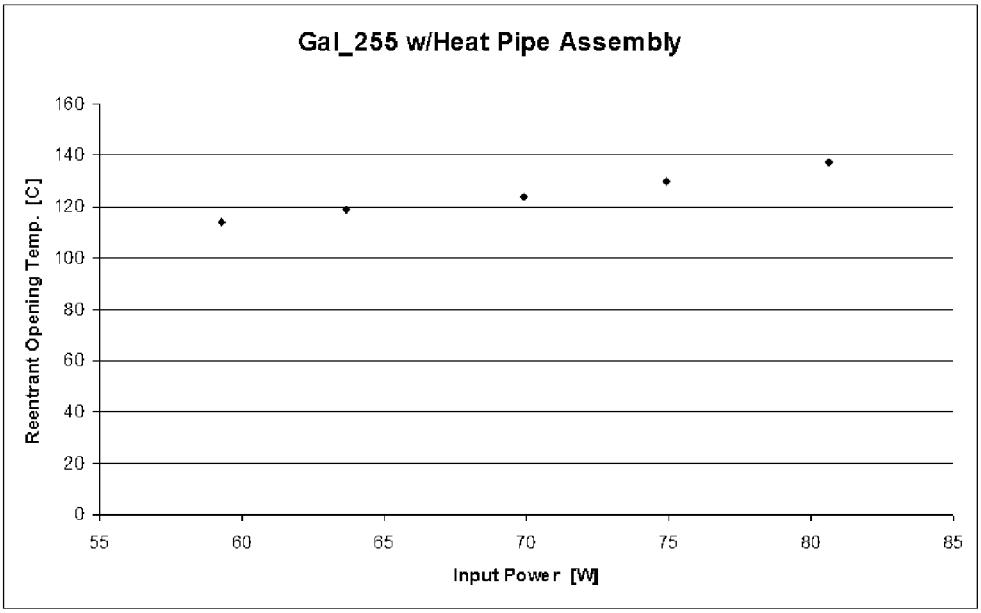
FIG. 7 is a chart of temperature of the surface of a discharge vessel versus input power according to an exemplary embodiment of the invention.

Referring to a specific example, a low pressure metal halide fluorescent lamp is provided according to another exemplary embodiment of the invention. A low pressure metal halide fluorescent lamp with thermal transfer pipes with a heat fin located was provided similar to the lamp 600 shown in FIG. 6. Ten turns of Teflon® coated wire around a ferrite core produce an exciter with an inductance of about 10 microhenries (uH). Four copper heat pipes 10 mm×150 mm from ACK Technology were cemented into the center bore of the ferrite core of the exciter. Both ends of the heat pipes extended from the core, and were held in machined boron nitride end caps via locking screws. A discharge vessel with overall dimensions of about 100 mm width and about 50 mm length and an exciter housing of about 30 mm diameter. The discharge vessel was filled and processed with 10 mg $GaI_3$, 2 mg Ga, and 33 Pa argon. The discharge medium was driven at 2.65 MHz by the exciter. A thermocouple was placed at the bottom exterior surface of the discharge vessel near a lower endcap, and the temperature recorded as a function of input power as shown in FIG. 7. As can be seen from the data in FIG. 7, temperatures sufficient to excite a GaI discharge for input powers above about 60 watts.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of this invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications. These procedures will enable others, skilled in the art, to best utilize the invention and various embodiments with various modifications. It is intended that the scope of the invention be defined by the following claims and their equivalents. Modifications and substitutions by one of ordinary skill in the art are considered to be within the scope of the present invention, which is not to be limited except by the following claims.

While there have been shown and described what are at present considered to be the preferred embodiments of the invention, it will be apparent to those skilled in the art that various changes and modifications can be made herein without departing from the scope of the invention as defined by the appended claims.

We claim:

1. A low pressure metal halide fluorescent lamp comprising:

an oblate spheroid discharge vessel filled with an ionizable metal halide surrounding an exciter housing wherein the exciter provides an RF sinusoidal current producing a toroidal-shaped plasma in the oblate spheroid cavity discharge vessel;

an exciter within the exciter housing for driving the ionizable metal halide in an inductively coupled electrodeless manner; and one or more heat transfer caps in contact with the exciter and an outer surface of the oblate spheroid discharge vessel.

2. The low pressure metal halide fluorescent lamp of claim 1, wherein said one or more heat transfer caps transfers heat by direct thermal conduction from the exciter to an outer surface of the oblate spheroid discharge vessel.

3. The low pressure metal halide fluorescent lamp of claim 1, wherein said one or more heat spreaders transfers heat from the exciter to a polar region surface of the oblate spheroid discharge vessel.

4. The low pressure metal halide fluorescent lamp of claim 2, wherein the one or more heat transfer caps are made of boron nitride.

5. The low pressure metal halide fluorescent lamp of claim 2, wherein a thermal paste couples the one or more heat transfer caps to the outer surface of the oblate spheroid discharge vessel.

6. The low pressure metal halide fluorescent lamp of claim 1, further comprises:

one or more thermal transfer pipes transferring heat from the exciter to an outer surface of the oblate spheroid discharge vessel.

7. The low pressure metal halide fluorescent lamp of claim 1, further comprises:

one or more thermal transfer pipes transferring heat from a core of the exciter to a polar region surface of the oblate spheroid discharge vessel.

8. The low pressure metal halide fluorescent lamp of claim 6, wherein the one or more thermal transfer pipes each has a thermal conductivity of about 12.6 W/cm*K.

9. The low pressure metal halide fluorescent lamp of claim 1, wherein the ionizable metal halide is gallium iodide.

10. The low pressure metal halide fluorescent lamp of claim 1, wherein the ionizable metal halide is gallium and a halogen and is mercury-free.

11. The low pressure metal halide fluorescent lamp of claim 1, wherein the oblate spheroid discharge vessel has an overall width of about 100 mm and an overall height of about 50 mm.

12. The low pressure metal halide fluorescent lamp of claim 1, wherein the oblate spheroid discharge vessel has an overall width of about 100 mm and an overall height of about 50 mm with the exciter housing having a cylindrical shape and a diameter of about 30 mm.

13. The low pressure metal halide fluorescent lamp of claim 1, wherein the lamp is operated at 60 watts and maintains the entire oblate spheroid discharge vessel surface at 110 C or greater.

14. A low pressure metal halide fluorescent lamp comprising:

a discharge vessel filled with an ionizable metal halide surrounding an exciter housing;

an exciter within the exciter housing for driving the ionizable metal halide in an inductively coupled electrodeless manner; and a top and bottom heat transfer cap in direct physical contact with the exciter and in direct physical contact with a polar region surface of the oblate spheroid discharge vessel wherein said polar region surface is not in direct physical contact with said exciter.

15. The low pressure metal halide fluorescent lamp of claim 14, further comprises:

one or more thermal transfer pipes transferring heat from a core of the exciter to the top and bottom heat transfer caps.

16. The low pressure metal halide fluorescent lamp of claim 14, wherein the ionizable metal halide is gallium and a halogen and is mercury-free.

17. The low pressure metal halide fluorescent lamp of claim 1, wherein the discharge vessel is an oblate spheroid shape and has an overall width of about 100 mm and an overall height of about 50 mm with the exciter housing having a cylindrical shape and a diameter of about 30 mm.

18. A low pressure metal halide fluorescent lamp comprising:

an oblate spheroid cavity discharge vessel with a top polar region surface and a bottom polar region surface filled with an ionizable metal halide surrounding an exciter housing;

an exciter within the exciter housing for driving the ionizable metal halide in an inductively coupled electrodeless manner;

a top heat transfer cap in contact with said top polar region and a bottom heat transfer cap in contact with said bottom polar region, wherein the top and bottom heat transfer caps transfer heat from the exciter to said polar region surfaces of the oblate spheroid cavity discharge vessel by direct thermal conduction; and one or more thermal transfer pipes transferring heat from a core of the exciter to the top and the bottom heat transfer caps wherein the lamp is operated at 60 watts and maintains the entire oblate spheroid cavity discharge vessel surface at 110 C or greater.

19. The low pressure metal halide fluorescent lamp of claim 1, wherein the ionizable metal halide is gallium and a halogen.

* * * * *